United States Patent [19]

Fillman

[11] 4,371,408

[45] Feb. 1, 1983

[54] LOW WATER EMULSION EXPLOSIVE COMPOSITIONS OPTIONALLY CONTAINING INERT SALTS

[75] Inventor: Harold T. Fillman, Bowie, Md.

[73] Assignee: Atlas Powder Company, Dallas, Tex.

[21] Appl. No.: 201,208

[22] Filed: Oct. 27, 1980

[51] Int. Cl.[3] ..... C06B 45/02

[52] U.S. Cl. ..... 149/21; 149/2; 149/38; 149/41; 149/47; 149/62; 149/76; 149/92

[58] Field of Search ..... 149/2, 21, 38, 41, 47, 149/62, 76, 92

[56] References Cited

U.S. PATENT DOCUMENTS

| | | | |
|---|---|---|---|
| 3,447,978 | 6/1969 | Bluhm | 149/2 |
| 3,674,578 | 7/1972 | Cattermole | 149/2 |
| 3,715,247 | 2/1973 | Wade | 149/21 |
| 3,765,964 | 10/1973 | Wade | 149/2 |
| 3,770,522 | 11/1973 | Tomic | 149/2 |
| 4,096,003 | 6/1978 | Machacek | 149/92 |
| 4,110,134 | 8/1978 | Wade | 149/2 |
| 4,130,449 | 12/1978 | Craig | 149/43 |
| 4,141,767 | 2/1979 | Sudweeks | 149/2 |
| 4,149,916 | 4/1979 | Wade | 149/56 |
| 4,149,917 | 4/1979 | Wade | 149/56 |
| 4,216,040 | 8/1980 | Sudweeks | 149/43 |
| 4,231,821 | 11/1980 | Sudweeks | 149/2 |

*Primary Examiner*—Stephen J. Lechert, Jr.
*Attorney, Agent, or Firm*—Richards, Harris & Medlock

[57] ABSTRACT

Sensitive, low water containing water-in-oil emulsion explosive compositions generally comprise a discontinuous aqueous oxidizer salt phase, a continuous carbonaceous fuel phase, and closed cell void containing materials are disclosed. Increased gap sensitivity, even in the presence of inert salts is achieved by employing an emulsion matrix of reduced water content (less than about 10%) in combination with an amine sensitizing agent and a relatively minor portion of a detonation catalyst, such as copper chloride.

26 Claims, No Drawings

LOW WATER EMULSION EXPLOSIVE COMPOSITIONS OPTIONALLY CONTAINING INERT SALTS

TECHNICAL FIELD

This invention relates to water-in-oil explosive compositions and, more specifically, to cap sensitive emulsion explosives. In another aspect, this invention relates to emulsion explosive compositions which are capable of achieving favorable incendivity and ½ cartridge gap sensitivity properties.

BACKGROUND ART

Water-in-oil emulsion type blasting agents were first disclosed by Bluhm in U.S. Pat. No. 3,447,978. These emulsion type blasting agents contain an aqueous solution of inorganic oxidizer salts that is emulsified as the dispersed phase within a continuous carbonaceous fuel phase, and a uniformly distributed gaseous component. Later, cap sensitive emulsion explosive compositions were produced using explosive additives such as trinitrotoluene, and pentaerythritol tetranitrate, (see e.g., U.S. Pat. No. 3,770,522). Water-in-oil emulsion explosive compositions have also been made cap sensitive by the addition of nonexplosive detonation catalysts (see e.g., U.S. Pat. Nos. 3,715,247 and 3,765,964). Most recently, cap sensitive water-in-oil emulsion type explosive compositions, containing neither explosive ingredients nor detonation catalysts, have been disclosed in U.S. Pat. Nos. 4,110,134, 4,149,916 and 4,149,917.

While the cap sensitive emulsion explosive compositions disclosed in the above-identified patents satisfy a wide range of requirements, there are certain blasting applications in which even higher sensitivities than are available using such compositions would be advantageous. Specifically, in coal mining where it is especially important that a string of cartridges be able to propagate the explosion from one cartridge to the next, ½ cartridge gap sensitivity tests are used to determine the suitability of the explosive for use in such applications. Basically, this test measures sensitivity in terms of the length of the air gap across which one half of a standard cartridge (1¼" by 8" in length) of explosive material can detonate a second half of a cartridge. Thus, for example, the preferred cap sensitive emulsion explosive composition as prepared according to the disclosures of U.S. Pat. No. 4,110,134, have an air gap sensitivity of about two inches. As noted above, cap sensitive compositions having sensitivities greater than those of heretofore available cap sensitive emulsion explosive compositions are desirable in certain blasting applications.

SUMMARY OF THE INVENTION

It has been discovered that cap sensitive water-in-oil emulsion explosive compositions having unexpectedly improved gap sensitivity can be prepared by employing an emulsion matrix containing less than about 10% by weight water, in combination with from about 0.25 to less than about 1% by weight copper chloride, from about 4% to about 15% of a lower alkylamine or alkanolamine nitrate sensitizing agent and conventional amounts of closed cell void containing materials. Thus, explosive compositions of the present invention which are sensitive to initiation by a No. 6 cap in diameters of 1.25 inches and less and which comprise from about 4 to less than about 10% by weight of the emulsion matrix of water, from about 65 to about 85% by weight of the composition inorganic oxidizing salts, from about 3.5 to about 8% by weight of the composition carbonaceous fuels including an emulsifier, from about 0.25 to about 15% by weight of the composition closed cell void containing materials, from about 3 to 5% by weight of the composition inert salt, from about 4% to about 15% by weight of the composition of a lower alkylamine or alkanolamine nitrate sensitizing agent and from about 0.25 to less than about 1.0% by weight of the composition nonexplosive detonation catalyst can be formulated to achieve improved sensitivity according to the present invention. Inert salts, such as sodium chloride for example, while not required, can be added to achieve better incendivity properties.

DETAILED DESCRIPTION OF THE INVENTION

Thus, quite unexpectedly, it has been discovered that by combining in one cap sensitive emulsion explosive composition the features of an emulsion matrix having a reduced water content, small amounts of a lower alkylamine or alkanolamine nitrate sensitizing agent and very small amounts of nonexplosive detonation catalyst (less than about 1%), unexpected sensitivity, as measured by the standard ½ cartridge gap sensitivity test can be attained. The compositions of the present invention in addition to being No. 6 cap sensitive in diameters of 1.25 inches and less, do not employ conventional high explosive sensitizers, are water resistant because of their emulsion characteristics, insensitive to initiation by fire, friction or static electricity, demonstrate good low temperature detonation characteristics and are stable enough for commercial utilization.

As used herein, the term "matrix" and/or "emulsion matrix" is defined as the water-in-oil emulsion including fuel, emulsifiers, water and inorganic oxidizing salts but excluding closed cell void-containing materials and auxiliary fuels (such as aluminum for example). Thus, I have discovered that by employing less than 10% by weight water in the emulsion matrix, the sensitivity of the emulsion explosive composition itself (prepared by admixing closed cell void-containing materials and, optionally, sensitizing agents with the matrix) is unexplainably increased.

The water-in-oil explosive emulsions of the present invention comprise, as a continuous phase thereof, from about 3.5% to about 8.0%, and preferably from about 4.5% to about 5.5% by weight of a carbonaceous fuel component, including an emulsifier. The carbonaceous fuel component can include most hydrocarbons, for example, paraffinic, olefinic, naphthenic, aromatic, saturated or unsaturated hydrocarbons. In general, the carbonaceous fuel is a water immiscible emulsifiable fuel that is either liquid or liquefiable at a temperature up to about 200° F., and preferably between about 110 and about 160° F. At least about 2.0% by weight of the total composition should be either a wax or oil, or a mixture thereof. If a mixture of wax and oil is employed, the wax content can preferably range from about 1.0% to about 3.0% by weight and the oil content can range from about 3.0% to about 1.0% by weight (depending on wax content) of the total emulsion.

Suitable waxes having melting points of at least about 80° F. such as petrolatum wax, microcrystalline wax, and paraffin wax, mineral waxes such as ozocerite and montan wax, animal waxes such as spermacetic wax, and insect waxes such as beeswax and Chinese wax can be used in accordance with the present invention. Examples of preferred waxes include waxes identified by the trade designations INDRA such as INDRA 5055-G, INDRA 4350-E, and INDRA 2119 sold by Industrial Raw Materials Corporation. Also suitable is ARISTO 143° sold by Union 76. Other suitable waxes are WHITCO 110X, WHITCO ML-445, and X145-A, which are marketed by Whitco Chemical Company Inc. The most preferred waxes are a blend of microcrystalline waxes and paraffin, such as the wax sold under the trade designation INDRA 2119, identified above. In this regard, more sensitive emulsions can be obtained by using a blend of microcrystalline wax and paraffin rather than microcrystalline or paraffin wax alone.

Suitable oils useful in the compositions of the present invention include the various petroleum oils, vegetable oils, and various grades of dinitrotoluene; a highly refined white mineral oil sold by Whitco Chemical Company, Inc. under the trade designation KAYDOL and the like.

The carbonaceous fuel component of the subject invention will also include the emulsifier used to form the emulsion explosive composition. Any of a wide variety of water-in-oil emulsifiers can be employed and the following examples are not to be interpreted as limiting. Thus, suitable emulsifiers which can be employed in the emulsion explosives of the present invention include those derivable from sorbitol by esterification with removal of one molecule of water such as sorbitan fatty acid esters, for example, sorbitan monolaurate, sorbitan monooleate, sorbitan monopalmitate, sorbitan monostearate, and sorbitan tristearate. Other useful materials comprise mono- and diglycerides of fat-forming fatty acids, as well as polyoxyethylene sorbitol esters, such as polyethylene sorbitol beeswax derivative materials and polyoxyethylene(4)lauryl ether, polyoxyethylene(2)ether, polyoxyethylene(2)stearyl ether, polyoxyalkylene oleate, polyoxyalkylene laurate, oleyl acid phosphate, substituted oxazolines and phosphate esters, mixtures thereof and the like. In general, the emulsifiers should be present in an amount ranging from about 0.5% to about 2.0% by weight of the total composition, and preferably from about 0.8% to about 1.2% by weight of the total composition.

The discontinuous aqueous phase of the explosive emulsions of the present invention are unusual in that they contain less than about 10% by weight of the emulsion matrix of water. Thus, the emulsion matrixes of the compositions of the present invention contain a minimum of about 4.0% water, less than about 10% by weight water and preferably from about 6% to about 8% water. The precise amount of water employed will depend, to some extent, upon the mixture of inorganic oxidizing salts which are employed.

The inorganic oxidizing salts dissolved in this unusually low amount of water will generally comprise from about 65% to about 85% by weight of the emulsion explosive composition. A major proportion of the inorganic oxidizing salt content is preferably comprised of ammonium nitrate; however, mixtures of ammonium nitrate and other alkali and alkaline earth metal nitrates as well as alkali and alkaline earth metal perchlorates can be successfully employed as the inorganic oxidizing salt components of the emulsions of the present invention. Preferred inorganic oxidizing salts, in addition to ammonium nitrate, include sodium nitrate and sodium or ammonium perchlorate. However, other nitrates and perchlorates, for example calcium nitrate, calcium perchlorate, potassium nitrate and potassium perchlorate can also be used.

The adjustments of the kinds and amounts of inorganic oxidizing salts to obtain an aqueous oxidizing salt solution phase for the emulsion matrix which contains reduced amounts of water is an important part of the subject invention. Especially preferred mixtures of inorganic oxidizing salts include from about 55% to about 70% ammonium nitrate in combination with from about 5% to about 20% sodium nitrate and up to about 10% ammonium or sodium perchlorate. Those skilled in the art will recognize that because of the various solubility characteristics of suitable inorganic oxidizing salts such as, for example, ammonium perchlorate, adjustment of water content within the range specified may be necessary according to the particular mix of inorganic oxidizing salts employed.

Thus, both the mix of inorganic oxidizing salts and the precise water content below about 10% by weight of the emulsion matrix are variables which can be adjusted to achieve the increased sensitivity of the compositions of the subject invention.

In addition, the emulsion explosive compositions of the present invention employ closed cell void containing materials as a sensitizing agent. Such materials can include any particulate material which comprises closed cell, hollow cavities. Each particle of the material can contain one or more closed cells, and the cells can contain a gas, such as air, or can be evacuated or partially evacuated. Sufficient closed cell void containing materials should be utilized to yield a density of the resulting emulsion of from about 0.9 to about 1.3 grams/cc. Generally, from about 0.25% to about 10% by weight of the explosive emulsion composition of such materials can be employed for this purpose.

The preferred closed cell void containing materials used in the compositions of the subject invention are discrete glass spheres having a particle size in the range from about 10 to about 175 microns. In general, the particle density of such bubbles can be within the range of about 0.1 to about 0.7 grams/cc. Some preferred types of glass microbubbles which can be utilized within the scope of the subject invention are the microbubbles sold by 3M Company and which have a particle size distribution in the range of from about 10 to about 160 microns and a nominal size in the range of from about 60 to 70 microns, and densities in the range of from about 0.1 to about 0.4 grams/cc. Preferred microbubbles sold by 3M Company are distributed under the trade designation B15/250. Further examples of such materials include those sold under the trade designation Eccospheres by Emerson & Cumming, Inc. and which generally have a particle size range of from about 44 to about 175 microns at a particle density of about 0.15 to about 0.4 grams/cc. Microbubbles sold under the designation Q-Cell 200 by Philadelphia Quartz Company are also suitable. When glass microbubbles are employed in the compositions of the subject invention, they can comprise from about 1.0% to about 5% by weight thereof.

In order to obtain the lower explosive temperatures necessary to pass the incendivity requirements for permissible type explosive compositions, the addition of inert salts, such as, for example, calcium chloride, potassium chloride or sodium chloride to the emulsion explosive compositions of the present invention may be required in some cases. Generally, from about 3 to about 5% by weight of the explosive emulsion composition of such inert salts can be added to the emulsion matrix of the explosive emulsions of the present invention to impart improved incendivity characteristics. The preferred salt is sodium chloride. It must be kept in mind, however, that the addition of inert salts to emulsion explosive compositions adversely affects ½ cartridge gap sensitivity.

It has been discovered that even when employing the above-stated amounts of inert salts to achieve desired incendivity characteristics the use of from about 4% to about 10% by weight of a lower alkylamine nitrate or alkanolamine nitrate sensitizing agent and from about 0.25 to less than about 1.0% by weight nonexplosive detonation catalyst, in combination with the low water emulsion matrixes of the present invention allows the explosive to retain surprisingly improved ½ cartridge gap sensitivity.

Lower alkylamine and alkanolamine nitrates which are useful include methylamine nitrate, ethylamine nitrate, ethanolamine nitrate, propanolamine nitrate, ethylenediamine dinitrate, and similar amine nitrates having from about one to about three carbon atoms. The preferred amine nitrate sensitizing agent for the emulsion of the present invention is ethylenediamine dinitrate.

Detonation catalysts, which are employed in the minor percentage stated above include inorganic metal compounds of atomic number 13 or greater, other than groups 1A and 2A of the periodic table and other than dioxides. Preferable detonation catalysts include compounds of copper, zinc, iron, or chromium. Compounds of aluminum, magnesium, cobalt, nickel, lead, silver and mercury are also suitable. For the purpose of this invention, silicon and arsenic are not considered to be metals. Nitrates, halides, chromates, dichromates and sulfates are preferred for their sensitivity and solubility. Oxides may also be used, but oxides are not as convenient as the other compounds because of their low solubility. Mixtures of various detonation catalysts are also contemplated. One especially preferred detonation catalyst is copper chloride. It should be noted here that experimentation has shown that good initial gap sensitivity can be obtained when using as much as 2% by weight of such detonation catalysts. However, formulations employing as much as 2% tend to lose their sensitivity with time while similar compositions which employ less than 1% retain their gap sensitivity upon aging. When water soluble detonation catalysts are employed they can be added during preparation of the inorganic oxidizing salt solution. Relatively insoluble oxides can be added to the emulsion matrix itself.

In addition to the above components of the explosive emulsions of the present invention, auxiliary fuels can also be employed. An excellent auxiliary fuel, which is nonexplosive, is particulate aluminum. Aluminum, and other nonexplosive auxiliary fuels, can be employed in amounts ranging from 0 to about 20% by weight of the emulsion explosive composition.

The explosive emulsions of the subject invention can be prepared by premixing the water and inorganic oxidizer salts and soluble detonation catalysts in a first premix, and the carbonaceous fuel and emulsifier in a second premix. The two premixes are heated, if necessary. The first premix is generally heated until the salts are completely dissolved (about 120° to about 220° F.) and the second premix is heated, if necessary, until the carbonaceous fuel is liquefied (generally about 120° F. or more if wax materials are utilized). The premixes are then blended together and emulsified, to form the emulsion matrix and thereafter the glass microbubbles, or other gas entrapping materials, are added until the density is lowered to the desired range.

In the continuous manufacture of emulsion explosive compositions, it is preferred to prepare an aqueous solution containing the oxidizers in one tank and to prepare a mix of the organic fuel components (excluding the emulsifier) in another tank. The two liquid mixes and the emulsifier are then pumped separately into a mixing device wherein they are emulsified. The emulsion matrix is next pumped to a blender where the glass microbubbles and insoluble auxiliary fuel, if desired, are added and uniformly blended to complete the water-in-oil emulsion. The resulting emulsion is then processed through a Bursa filler or other conventional device into packages of desired diameters. For example, the emulsion explosives can be packaged in spiral wound or convoluted polymer laminated paper cartridges.

The following examples are given to better facilitate the understanding of the subject invention, but are not intended to limit the scope thereof.

As set forth in Table I below, compositions were prepared by mixing the inorganic oxidizers, salt, copper chloride and amine sensitizer with water at about 220° F. to prepare a premix. A second mix of carbonaceous fuel and the emulsifier was then prepared at 150° F. The first premix was then slowly added to the second premix with agitation to form a water-in-oil emulsion matrix. Thereafter, the glass microbubbles were blended into the emulsion to form the final composition.

TABLE I

| | Compositions | | | | | | |
|---|---|---|---|---|---|---|---|
| Ingredients | 1 | 2 | 3 | 4 | 5 | 6 | 7 |
| Water | 8.0 | 8.0 | 8.0 | 8.0 | 8.0 | 8.0 | 8.0 |
| Wax | 3.0 | 3.0 | 3.0 | 3.0 | 3.0 | 3.0 | 3.0 |
| Oil | 1.0 | 1.0 | 1.0 | 1.0 | 1.0 | 1.0 | 1.0 |
| Emulsifier | 1.0 | 1.0 | 1.0 | 1.0 | 1.0 | 1.0 | 1.0 |
| Ammonium Nitrate | 64.0 | 61.0 | 61.5 | 61.75 | 59.5 | 61.0 | 56.5 |
| Sodium Nitrate | 10.0 | 10.0 | 10.0 | 10.0 | 10.0 | 10.0 | 10.0 |
| $CuCl_2$ | 1.0 | 1.0 | 0.5 | 0.25 | .5 | 1.0 | 0.5 |
| NaCl | — | 3.0 | 3.0 | 3.0 | 5.0 | 3.0 | 3.0 |
| MAN | — | — | — | — | — | 10.0 | 15.0 |
| EDDN | 10.0 | 10.0 | 10.0 | 10.0 | 10.0 | — | — |
| Glass Microspheres | 2.0 | 2.0 | 2.0 | 2.0 | 2.0 | 2.0 | 2.0 |
| Cap Sensitivity | #6 | #6 | #6 | #6 | #6 | #16 | #6 |
| Gap Sensitivity | 5" | <3" | 4" | 3" | 3" | <3" | 3" |
| Density | 1.17 | 1.18 | 1.18 | 1.17 | 1.17 | 1.18 | 1.17 |

All of the compositions set forth in Table I were extruded or tamped into paper tubes having a 1¼ inch diameter, and sealed.

Composition Nos. 3, 4, 5 and 7 set forth in Table I are exemplary of explosive compositions prepared according to the subject invention. Each of those compositions obtained an air gap sensitivity of at least 3 inches, even though they contained a significant amount of sodium chloride. Instructive of the synergistic effect of low amounts of detonation catalysts in combination with low water content, and lower alkylamine or alkanolamine sensitizing compositions are demonstrated by a comparison of compositions Nos. 1, 2 and 6 to the compositions exemplary of this invention (Nos. 3, 4, 5 and 7). In Example No. 1, no salt was present in the composition and thus, even though a gap sensitivity of 5 inches was obtained, the composition would be expected to have a high explosion temperature. When three weight percent of sodium chloride was added to this composition to prepare composition No. 2, in order to lower the explosion temperature gap sensitivity fell below three inches. Surprisingly, however, when composition No. 2 is changed solely by reducing the amount of copper chloride from 1% to 0.5% by weight to form composition No. 3, a ½ cartridge gap sensitivity of 4 inches was obtained even though inert salt (added to reduce explosion temperature) was present.

Example No. 4 demonstrates that as little as 0.25 weight percent copper chloride can be employed while still obtaining good sensitivity in the presence of inert salts. Composition No. 5 demonstrates that as much as 5 weight percent sodium chloride can be used while still preserving good ½ cartridge air gap sensitivity.

In Example No. 6, 10% monomethylamine nitrate was substituted for ethelynediamine dinitrate and was used in combination with 1 weight percent copper chloride and 3 weight percent salt. A ½ cartridge air gap sensitivity of less than 3 inches was obtained. Upon adjusting the ingredients of composition No. 6 to prepare composition No. 7 (by increasing the monomethylamine nitrate to 15% and reducing the copper chloride to 0.5% by weight) good air gap sensitivity was attained even in the presence of the inert salt.

While the subject invention has been described in relation to its preferred embodiments, it is to be understood that various modifications thereof will be apparent to those of ordinary skill in the art upon reading the specification, and it is intended to cover all such modifications which fall within the scope of the appended claims.

I claim:

1. A water-in-oil explosive emulsion composition having a ½ cartridge gap sensitivity of at least about three inches formed from an emulsion matrix having:

from about 4% to less than about 10% by weight water, and comprising from about 4% to about 10% by weight of the total explosive emulsion composition of a lower alkylamine, nitrate or alkanolamine nitrate sensitizing agent and from about 0.25 to less than about 1% by weight of the total explosive emulsion composition nonexplosive detonation catalyst.

2. The water-in-oil emulsion composition of claim 1 wherein from about 65% to about 85% by weight of the total composition is inorganic oxidizing salts, from about 3.5% to about 8% by weight of the total composition is carbonaceous fuels, including an emulsifier and from about 0.25% to about 10% by weight of the total composition is closed cell void containing materials.

3. The explosive composition of claim 1 wherein said detonation catalyst is selected from the group consisting of water soluble nitrate, halide, chromate, dichromate, and sulfur compounds in which said compound contains a metal selected from the group consisting of aluminum, magnesium, cobalt, nickel, lead, silver, mercury, copper, zinc, iron, and chromium.

4. The explosive composition of claim 1 wherein said detonation catalyst is copper chloride.

5. The composition of claim 1 and further comprising from about 3 to about 5% by weight of the total composition of an inert salt.

6. The explosive composition of claim 5 wherein said inert material is sodium chloride.

7. The explosive emulsion of claim 2 wherein the emulsifier present in said carbonaceous fuels is in the range of from about 0.5 to about 2.0% by weight of said explosive emulsion composition.

8. The explosive composition of claim 2 wherein said inorganic oxidizing salts comprise from about 55% to about 70% by weight of the total composition of ammonium nitrate, from about 5% to about 20% by weight of the total composition of sodium nitrate and from about 0% to about 20% by weight of the total composition of ammonium perchlorate.

9. The explosive composition of claim 2 wherein said carbonaceous fuel comprises water immiscible emulsifiable material selected from the group consisting of petrolatum, microcrystalline, paraffin, mineral, animal, and insect waxes, petroleum oils, vegetable oils and mixtures thereof.

10. The explosive composition of claim 2 wherein said closed cell void containing material is glass microbubbles and is present in an amount of from about 1.0 to about 5% by weight of the total composition.

11. The explosive composition of claim 1 wherein said sensitizing agent is ethylenediamine dinitrate and is present in an amount of from about 4% to about 10% by weight.

12. The explosive composition of claim 1 wherein said sensitizing agent is monomethylamine nitrate and is present in an amount of from about 4% to about 10% by weight.

13. The explosive composition of claim 2 and further comprising up to about 20% by weight of the total composition of auxiliary fuels.

14. The explosive composition of claim 13 wherein said auxiliary fuel is particulate aluminum.

15. The explosive composition of claim 2 wherein said carbonaceous fuel comprises water immiscible emulsifiable material selected from the group consisting of petrolatum, microcrystalline, paraffin, mineral, animal, and insect waxes, petroleum oils, vegetable oils and mixtures thereof.

16. The explosive composition of claim 2 wherein said closed cell void containing material is glass microbubbles and is present in an amount of from about 1.0% to about 5% by weight of the total composition.

17. In a water-in-oil explosive emulsion comprising a discontinuous aqueous oxidizer salt solution phase, a continuous carbonaceous fuel phase, and closed cell void containing materials, the improvement comprising:

employing in combination an emulsion matrix comprising less than about 10% by weight water, from about 4% to about 10% by weight of the explosive emulsion composition of a lower alkylamine nitrate or alkanolamine nitrate sensitizing agent and from about 0.25% to less than about 1% by weight nonexplosive detonation catalyst to obtain increased sensitivity.

18. The improved explosive composition of claim 17 wherein water is present in said matrix in an amount of from about 6% to about 8% by weight.

19. The improved explosive composition of claim 17 wherein said carbonaceous fuel phase, including an emulsifier, is present in an amount of from about 3.5% to about 8% by weight of the total composition.

20. The improved explosive composition of claim 17 wherein said closed cell void containing materials are present in sufficient amounts to obtain a density of from about 0.9 to about 1.3 g/cc for the total composition.

21. The improved explosive composition of claim 17 wherein said closed cell void containing materials are present in an amount of from about 0.25% to about 10% by weight of the total composition.

22. The improved explosive composition of claim 17 wherein said carbonaceous fuel phase includes a water-in-oil emulsifier in an amount of from about 0.5% to about 2.0% by weight of the total composition.

23. The improved explosive composition of claim 17 wherein the inorganic oxidizing salts contained in said discontinuous aqueous oxidizer salt solution phase comprise from about 55% to about 70% by weight of the total composition of ammonium nitrate, from about 5% to about 20% by weight of the total composition of sodium nitrate and from about 0% to about 20% by weight of the total composition of ammonium or sodium perchlorate.

24. The improved explosive composition of claim 17 and further comprising from about 0% to about 20% by weight of the total composition of an auxiliary fuel.

25. The improved explosive composition of claim 23 wherein said auxiliary fuel is particulate aluminum.

26. The improved explosive composition of claim 17 and further comprising from about 3% to about 5% by weight of the total composition of an inert salt.

* * * * *